US007195537B1

(12) United States Patent
Chien et al.

(10) Patent No.: US 7,195,537 B1
(45) Date of Patent: Mar. 27, 2007

(54) SYSTEMS AND METHODS FOR DETECTING DEVICE-UNDER-TEST DEPENDENCY

(75) Inventors: Volume Chien, Sinying (TW); Chyi-Shyuan Chern, Taipei (TW); Yu Yuan Kuo, Singang Township, Chiayi County (TW); Ming-Te Mo, Tainan (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 0 days.

(21) Appl. No.: 11/245,532

(22) Filed: Oct. 7, 2005

(51) Int. Cl.
*B24B 49/00* (2006.01)

(52) U.S. Cl. ..... 451/5; 451/8

(58) Field of Classification Search ..... 451/5, 451/6, 8–10, 41, 57, 65
See application file for complete search history.

(56) References Cited

U.S. PATENT DOCUMENTS 6,640,151 B1 * 10/2003 Somekh et al. ..... 700/121
6,698,009 B1 * 2/2004 Pasadyn et al. ..... 716/19
6,751,518 B1 * 6/2004 Sonderman et al. ..... 700/121
2002/0192966 A1 * 12/2002 Shanmugasundram et al. ..... 438/692
2005/0032459 A1 * 2/2005 Surana et al. ..... 451/5

* cited by examiner

*Primary Examiner*—Dung Van Nguyen
(74) *Attorney, Agent, or Firm*—Thomas, Kayden, Horstemeyer & Risley

(57) ABSTRACT

A system of process control is provided. The system comprises a first processing tool, a first sensor, a second processing tool, and a processor. The first processing tool processes a first workpiece. The first sensor provides real-time monitoring (RTM) data of the first processing tool while processing the first workpiece. The second processing tool processes the first workpiece subsequent to the first processing tool. The processor adjusts, according to the real-time monitoring data and a preset program, the first processing tool for processing a second workpiece, and the second processing tool for processing the first workpiece.

3 Claims, 4 Drawing Sheets

SYSTEMS AND METHODS FOR DETECTING DEVICE-UNDER-TEST DEPENDENCY

BACKGROUND

The present invention relates to semiconductor manufacturing, and more particularly, to systems and methods of real-time control of processing tools.

FIGS. 1*a* and 1*b* illustrate operation of a conventional advanced process control (APC). FIG. 1*a* schematically shows a chemical mechanical polishing (CMP) fabrication system implementing APC. A CMP station 100 comprises three individual operable CMP platens 101, 102 and 103. A process controller 110 is operatively connected to the CMP station 100. The process controller 110 is configured to receive information from a metrology tool 120 and from the CMP station 100. Additionally, the process controller 110 may receive information pertaining to a product 130 to be processed by the CMP station 100, and information pertaining to a process recipe 140 specifying process settings of CMP station 100.

FIG. 1*b* is a flowchart illustrating the operation of the fabrication system shown in FIG. 1*a*. In step S150, an initial process state is determined. Here, a process state represents a removal rate at each of the CMP platens 101, 102 and 103. The process state may also represent the removal rate and the associated degree of dishing and erosion at each of the CMP platens 101, 102 and 103, or a total removal rate of the CMP station 100. The product 130 is then processed with process settings adjusted on the basis of the initial process state.

In step S155, a current process state is determined according to a preset process model and historical information received from metrology tool 120, CMP station 100, a product 130 to be processed and a corresponding process recipe. Generally, measurement results obtained from the metrology tool 120 may be delayed or may not be available unless a plurality of products 130 is completely processed.

In step S160, one or more control wafer is processed, and the process state is adjusted accordingly.

In step S165, a new process state is determined from a previous process state.

In step S170, it is determined whether a reset event occurs. The process flow continuously updates the process state when no reset event occurs. For example, the reset event occurs when the lifetime of a consumable has expired or will soon expire, a polishing head has to be replaced, a machine failure has occurred, the type of product is to be changed, or the process recipe has to be changed, and the like. Any of these events may render the process state unpredictable and, therefore, process controller 110 is re-initialized with the initial state set in advance and the process continues as depicted in FIG. 1*b* on the basis of newly gathered history information after the reset event.

Hence, a system that addresses problems arising from the existing technology is desirable.

SUMMARY

A system of process control is provided. The system comprises a first processing tool, a first sensor, a second processing tool, and a processor. The first processing tool processes a first workpiece. The first sensor provides real-time monitoring (RTM) data of the first processing tool while processing the first workpiece. The second processing tool processes the first workpiece in successive of the first processing tool. The processor adjusts, according to the real-time monitoring data and a preset program, the first processing tool for processing a second workpiece, and the second processing tool for processing the first workpiece.

Also disclosed is a method of process control. A first workpiece is processed. Real-time monitoring (RTM) data is provided, wherein the RTM data pertains to the first processing tool while processing the first workpiece. The first processing tool is adjusted for processing a second workpiece according to the real-time monitoring data and a preset program. A second processing tool is adjusted for processing the first workpiece according to the real-time monitoring data and a preset program.

The above-mentioned method may take the form of program code embodied in a tangible media. When the program code is loaded into and executed by a machine, the machine becomes an apparatus for practicing the invention.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION

The invention will now be described with reference to FIGS. 2 and 3, which generally relate to a system and a method of process control.

In the following detailed description, reference is made to the accompanying drawings which form a part hereof, and in which is shown by way of illustration of specific embodiments. These embodiments are described in sufficient detail to enable those skilled in the art to practice the invention, and it is to be understood that other embodiments may be utilized and that structural, logical and electrical changes may be made without departing from the spirit and scope of the present invention. The following detailed description is, therefore, not to be taken in a limiting sense. The leading digit(s) of reference numbers appearing in the figures corresponds to the figure number, with the exception that the same reference number is used throughout to refer to an identical component which appears in multiple figures.

Figure 1A:
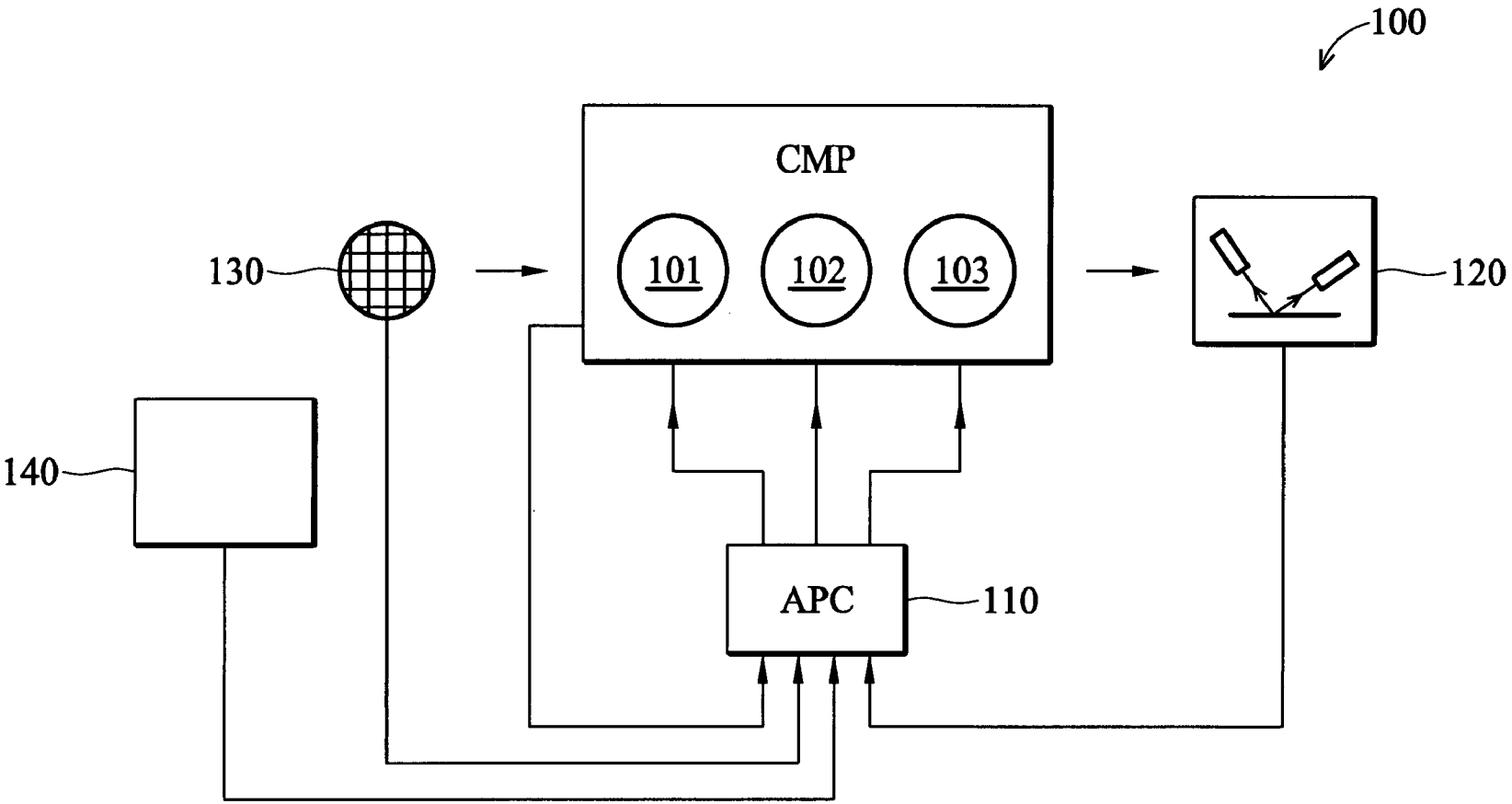
FIG. 1a (RELATED ART)
FIG. 1*a* is a schematic view of a conventional fabrication system.
Figure 1B:
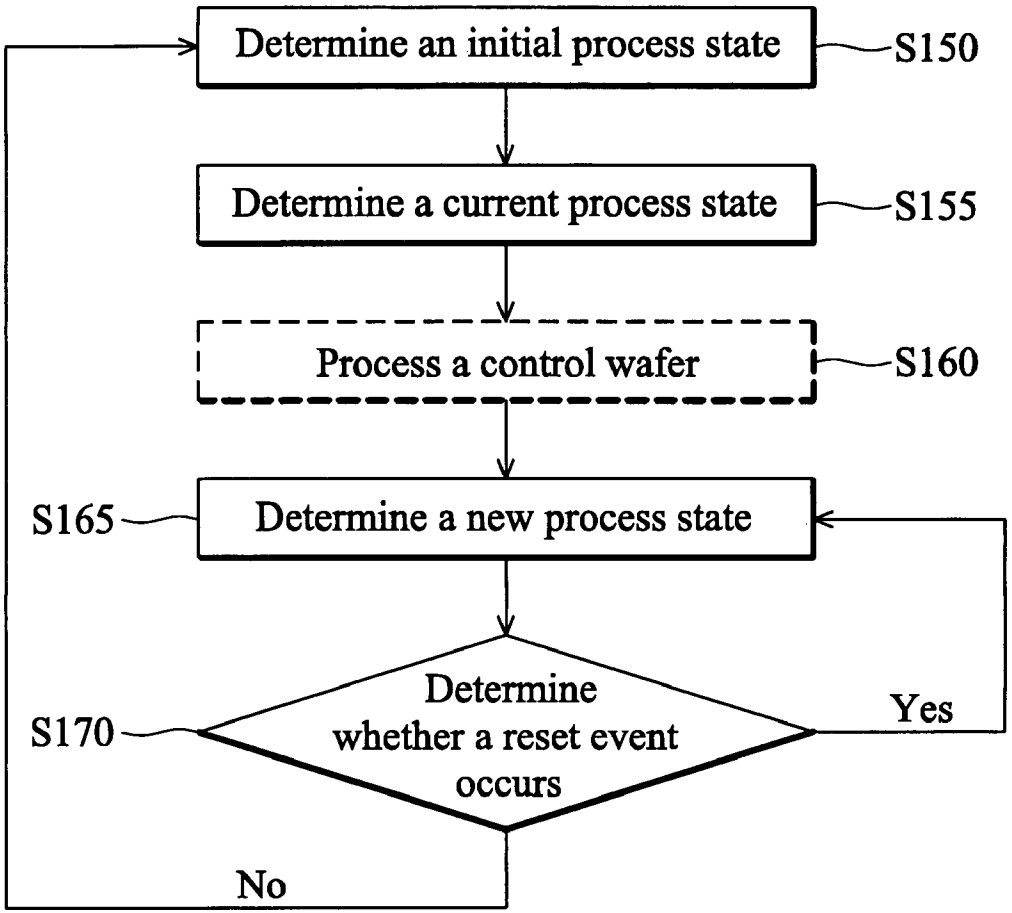
FIG. 1b (RELATED ART)
FIG. 1*b* is a flowchart illustrating operation of the fabrication system illustrated in FIG. 1*a;*
Figure 2:
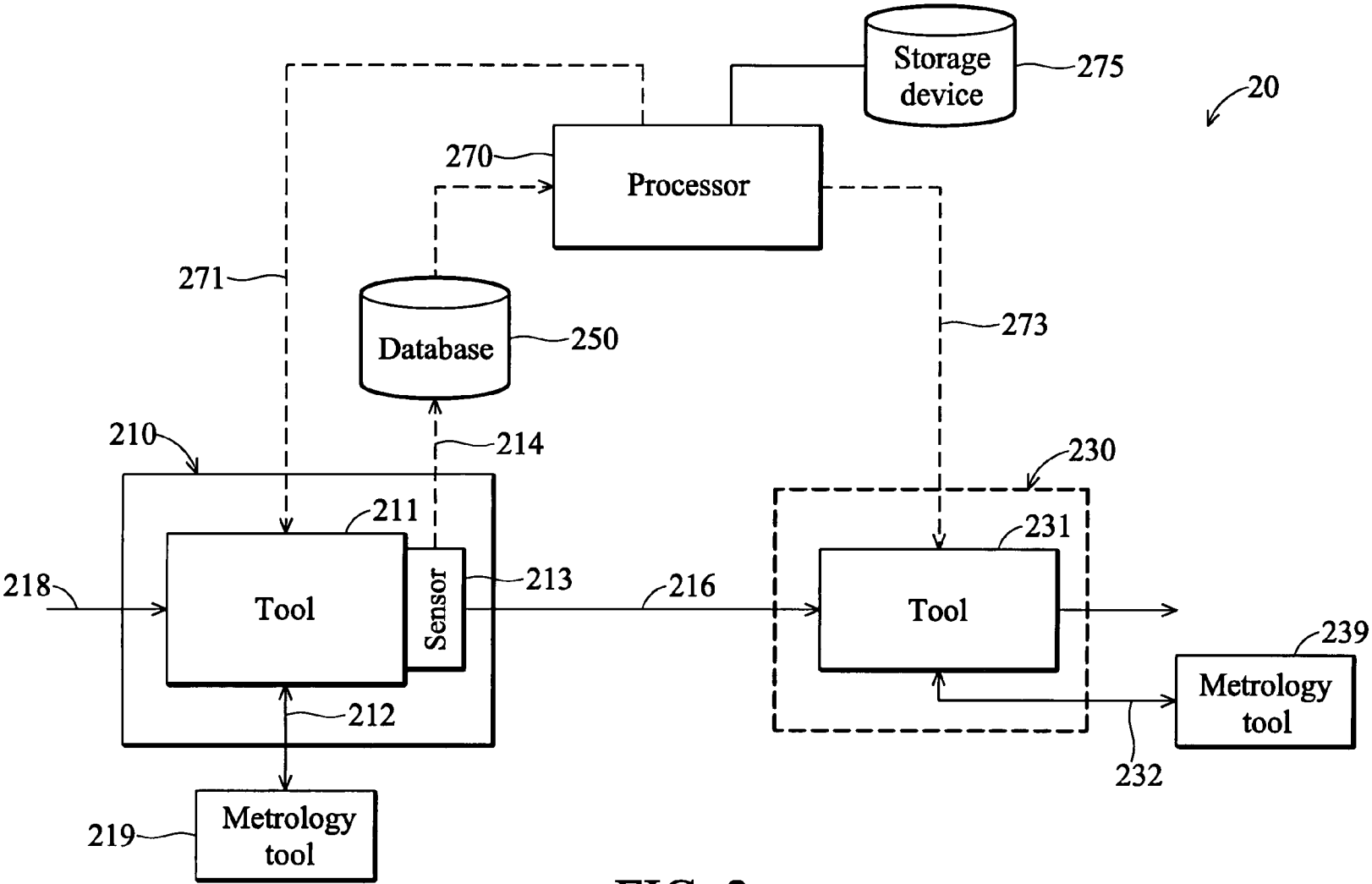
FIG. 2 illustrates an embodiment of a fabrication system implementing a process control.

FIG. 2 illustrates an embodiment of a fabrication system implementing a process control. A fabrication system 20 is a semiconductor fabrication system comprising a plurality of processing stations performing different processing steps, wherein each of the processing stations comprises a plurality of tools each performing a specific processing step respectively. Here, fabrication system 20 comprises a deposition station 210 and a polishing station 230. A tool 211 of deposition station 210 deposits a thin film on a wafer, and a tool 231 of polishing station 230 polishes a deposited thin film to a preset thickness. When tool 211 performs a deposition process, a sensor 213 provides real-time monitoring (RTM) data of tool 211 while processing a first wafer. The sensor 213 can be a built-in sensor of tool 211 or an external sensor. RTM data 214 is transmitted from sensor 213 to a database 250. Generally, contents of RTM data 214 is predetermined by a manufacturer of the tool 211. RTM data 214 can be transmitted based on a RS-232 standard, a SECS standard or other transmission standards. RTM data stored in database 250 is retrieved by a processor 270. The retrieved RTM data is then processed according to a first preset program and a second preset program for determining a feed-forward parameter 271 and a feed-back parameter 273. The first and second preset programs can be stored in a storage device 275. The first and second preset programs can be determined using experiments, specifying relationships between a wafer characteristic and at least one type of the RTM data corresponding to the tools 211 and 231. The feed-forward parameter 271 is used for adjusting tool 211 for processing a wafer 218, and feed-backward parameter 273 is used for adjusting tool 231 for processing the wafer 216. In addition to adjusting tools using the RTM data, daily monitoring can be performed using at least one control wafer. The daily monitoring for tool 211 can be performed using a metrology tool 219. When performing daily monitoring, a control wafer 212 is first processed by tool 211, and a certain characteristic of the processed control wafer 212 is measured by the metrology tool 219. The measured characteristic of the processed control wafer 212 is used for adjusting tool 211. Similarly, daily monitoring for tool 231 can be performed using a metrology tool 239. When performing the daily monitoring, a control wafer 232 is first processed by tool 231, and certain characteristic of the processed control wafer 232 is measured by the metrology tool 239. The measured characteristic of the processed control wafer 232 is used for adjusting tool 231.

Figure 3:
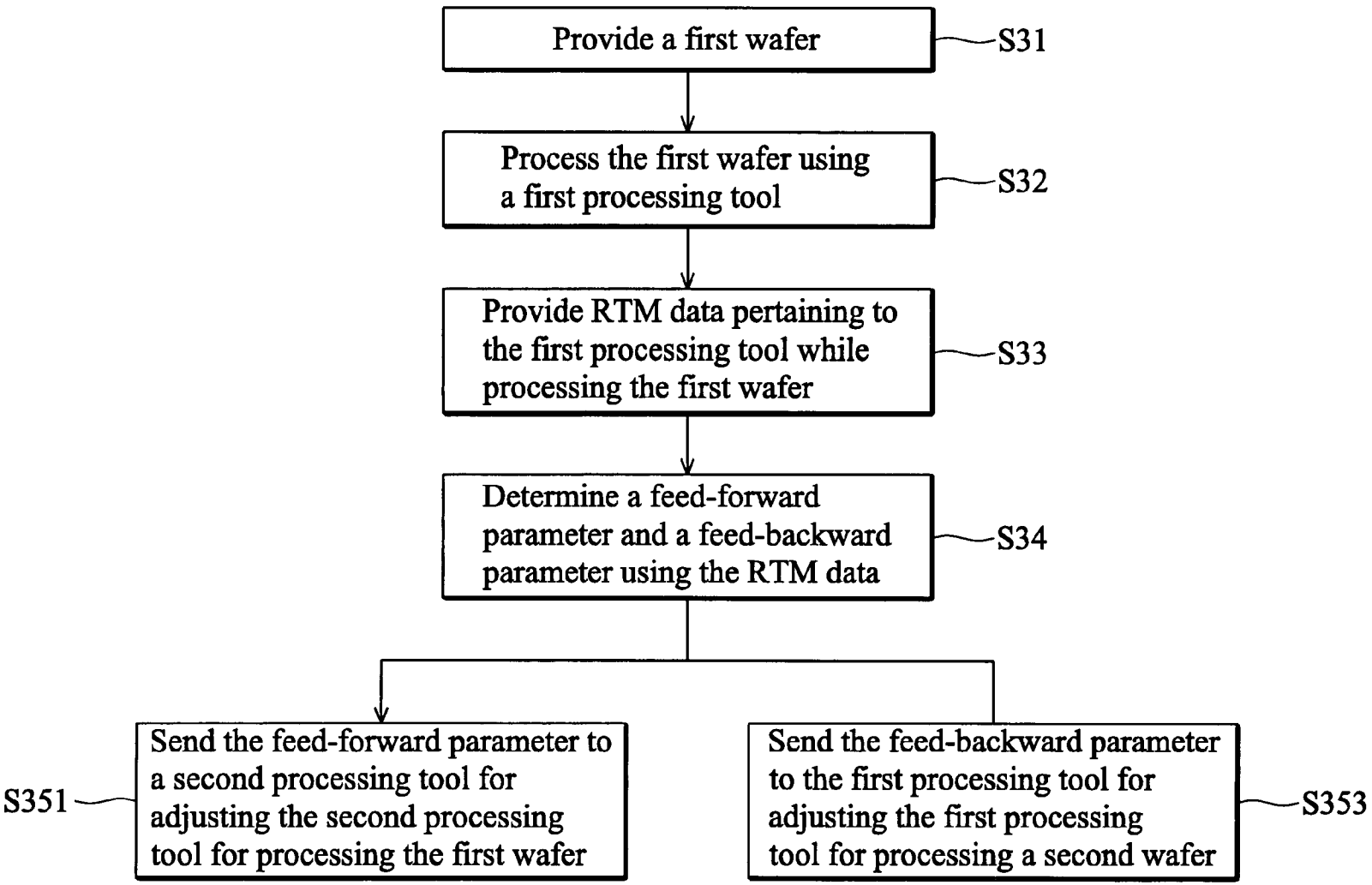
FIG. 3 illustrates a flowchart of an embodiment of a method of process control.

FIG. 3 is a flowchart of an embodiment of a method of process control. In step S31, a first wafer is provided. In step S32, the first wafer is processed by a first processing tool. In step S33, real-time monitoring (RTM) data is provided, wherein the RTM data pertains to the first processing tool as if processes the first wafer. In step S34, the RTM data is loaded in a preset program to determine a feed-forward parameter and a feed-backward parameter. In step S351, the feed-forward parameter is sent to a second processing tool for adjusting the second processing tool for processing the first wafer. In step S353, the feed-backward parameter is sent to the first processing tool for adjusting the first processing tool for processing a second wafer.

According to the invention, the processing tools can adjusted on a wafer by wafer basis, rather than the conventional lot basis. With the wafer-basis adjustment, frequency of the time-consuming monitoring process using a control wafer can be reduced.

While the invention has been described by way of example and in terms of the preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A computer program embodied in a computer readable medium providing a method of process control, wherein the computer program is encoded on a computer-readable medium, the method comprising:

determining a first program by experiment, wherein the first program specifies relationships between a workpiece characteristic and at least one type of the RTM data corresponding to a first processing tool;

determining a second program by experiments, wherein the second program specifies relationships between a workpiece characteristic and at least one type of the RTM data corresponding to a second processing tool;

receiving real-time monitoring (RTM) data of a first processing tool while processing a first workpiece; and determining a process setting of the first processing tool for processing a second workpiece according to the real-time monitoring data and the first program; and determining a process setting of the second processing tool for processing the first workpiece according to the real-time monitoring data and the second program.

2. The computer program of claim 1, wherein the method further receives characteristic measurements of at least one monitor workpiece processed by the first and second processing tools.

3. The computer program of claim 1, wherein the method further adjusts the first and second processing tools using the characteristic of the processed monitor workpiece.

* * * * *